United States Patent [19]

Schmidt-Hatting

[11] 4,396,483

[45] Aug. 2, 1983

[54] ARRANGEMENT OF BUSBARS FOR ELECTROLYTIC REDUCTION CELLS

[75] Inventor: Wolfgang Schmidt-Hatting, Rüti, Switzerland

[73] Assignee: Swiss Aluminium Ltd., Chippis, Switzerland

[21] Appl. No.: 405,888

[22] Filed: Aug. 6, 1982

[30] Foreign Application Priority Data

Aug. 18, 1981 [CH] Switzerland ..... 5320/81

[51] Int. Cl.[3] ..... C25C 3/16

[52] U.S. Cl. ..... 204/243 M; 204/244

[58] Field of Search ..... 204/243 M, 244, 67, 204/243 R, 245–247

[56] References Cited

U.S. PATENT DOCUMENTS 4,049,528 9/1977 Morel et al. ..... 204/243 M
4,194,958 3/1980 Nebell ..... 204/243 M
4,270,993 6/1981 Arita ..... 204/243 M X
4,313,811 2/1982 Blanc ..... 204/243 M

*Primary Examiner*—Donald R. Valentine
*Attorney, Agent, or Firm*—Bachman and LaPointe

[57] ABSTRACT

An arrangement of busbars leads the direct electric current from a transverse electrolytic cell in particular such a cell for producing aluminum, to the anode beam of the next cell. The self consistent magnetic field of the cell is almost completely compensated if, at the upstream cathode bar ends, at least two individual or groups of cathode busbars and connecting busbars lead to a busbar connected to the downstream cathode bar ends or to a riser. A part of the connecting busbar runs completely under the cell at the middle; the other part likewise runs under the cell until it is in the region of the longitudinal axis (L) where it follows this axis until it projects out beyond the end wall of the cell, and finally runs along the cell.

9 Claims, 1 Drawing Figure

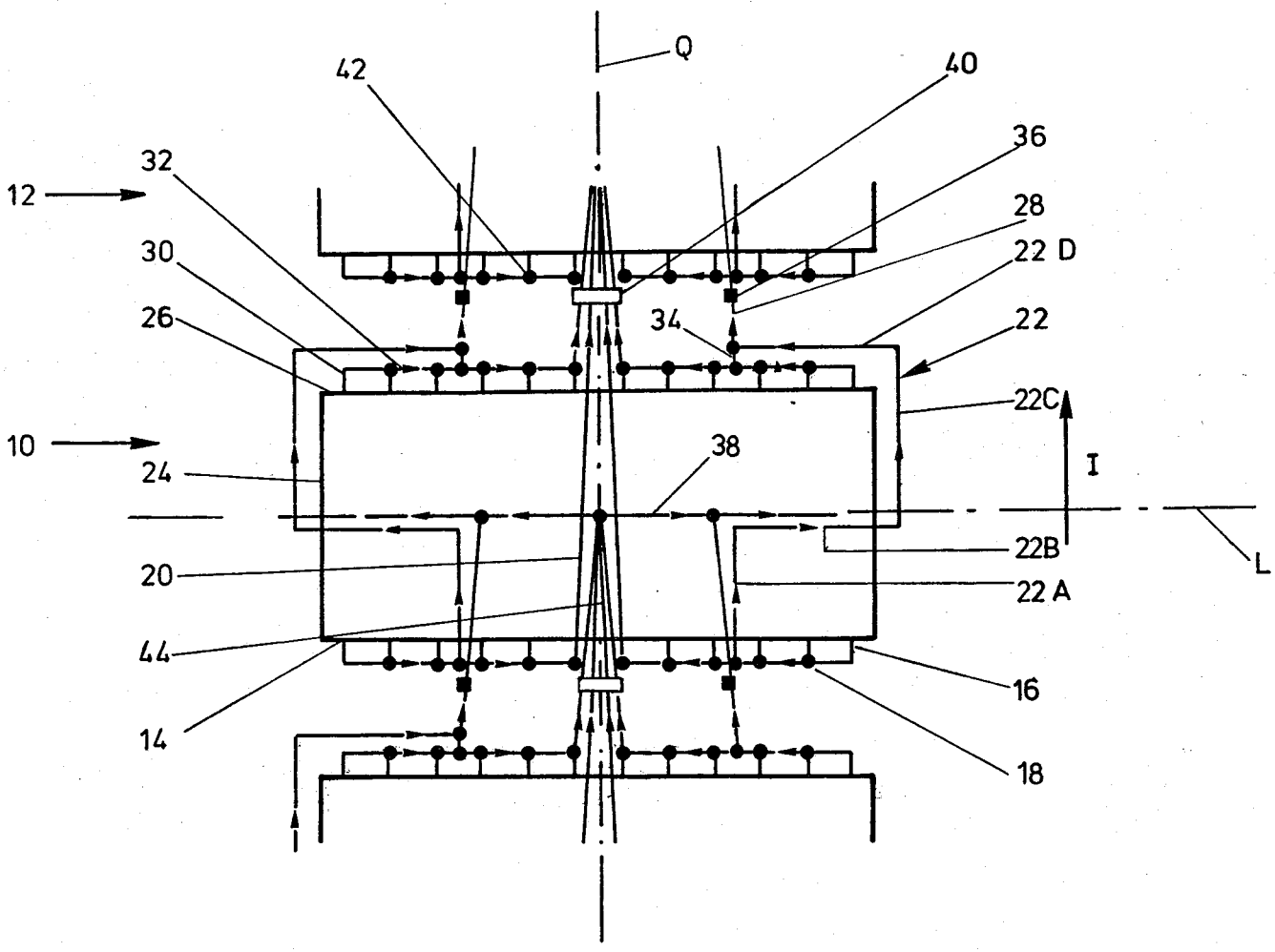
L
I
36
28
22 D
22
22C
22B
22 A
16
18
40
38
34
Q
42
32
30
26
24
20
44
14
12
10

ARRANGEMENT OF BUSBARS FOR ELECTROLYTIC REDUCTION CELLS

BACKGROUND OF THE INVENTION

The invention relates to an arrangement of busbars for conducting direct electric current from the cathode bar ends of one transverse electrolytic reduction cell, in particular such a cell for producing aluminum, to the long side of the anode beam of the next cell, via cathode busbars, connecting busbars and risers, and such that a part of the connecting busbars is positioned under the cell.

In the fused salt electrolytic process for producing aluminum, aluminum oxide is dissolved in a fluoride melt comprised for the greater part of cryolite. The cathodically precipitated aluminum collects on the floor of the cell underneath the fluoride melt, the surface of that liquid aluminum itself acting as the cathode. Dipping into the melt from above are anodes which, in conventional processes, are made of amorphous carbon. At the carbon anodes oxygen is formed as a rsult of the decomposition of the aluminum oxide; this oxygen then combines with the carbon of the anodes to form $CO_2$ and CO. The electrolytic process takes place in the temperature range of approx. 940°-970° C.

In the course of the process the electrolyte becomes depleted in aluminum oxide. When the concentration of aluminum oxide in the electrolyte reaches a lower limit of 1-2 wt%, the anode effect occurs, resulting in an increase in voltage from 4-5 V to 30 V and higher. Then at the latest the crust of solid electrolyte must be broken open and the concentration of aluminum oxide raised by adding alumina to the bath.

A smelter pot room has at least two rows of longitudinal or transverse cells through which the direct electric current flows in series. In each row of cells there is always at least one return conductor bar which produces a vertical magnetic force, which markedly disturbs the desired magnetic symmetry in the cell. These vertical components of induced magnetic field are the main cause of the magnetic effects viz., stirring and doming of the metal in the pot; the reason for this is that they interact mainly with the horizontal components of current density in the metal to produce strong magnetic forces.

The electrolyzing current which flows through the anode beam, the anode rods, the anodes, electrolyte, liquid metal, carbon floor and cathode bars produces a self-consistent magnetic field in the cell with strong vertical components in the four corners. If the busbars connecting the ends of the cathode bars of one cell to the anode beam of the next cell are arranged symmetrically, they tend to reinforce this self-consistent field.

Recently therefore various efforts have been made to lead the connecting busbars from transverse cells in such a way that the vertical components of this self-consistent field are compensated as much as possible by the magnetic field of the connecting busbars. However, attention must be given to the influence of the vertical magnetic forces from the return conductors i.e. the neighboring row of cells. Attempts to compensate for this effect have been made by arranging the connecting busbars asymmetric with respect to the transverse axis of the cell.

In the German patent application DE-OS No. 26 53 643 compensation of the vertical magnetic forces is attempted by connecting different numbers of cathode bar ends on at least one side of the transverse cell to the busbar leading to the anode beam of the next cell. In terms of an additional magnetic field, this has the same effect as separating the cathode busbar at a particular point.

In the U.S. Pat. No. 4,224,127 cells for producing aluminum by the fused salt electrolytic process are described in which the electric current leaving the cell via the cathode bar ends at the long sides of the cell is conducted asymmetrically to the anode beam of the next cell via at least four collector busbars. These collector or connecting busbars leading the current off in opposite directions are arranged at different spacings on both long sides of the cell, however such that the distances between two diametrically opposite collector busbars are the same.

In contrast to these two published items, which are aimed mainly at compensating for the vertical magnetic forces produced by the return conductors, in the U.S. Pat. No. 3,969,213 an attempt is made to compensate for the self consistent field of the cell by special arrangement of the connecting busbars. In the U.S. Pat. No. 3,969,213 there are two types of connecting busbars:

The first type takes the current from one or more upstream cathode bar end and conducts this via flexible strips under the cell, in the direction of the transverse axis, to the middle, and from there in the longitudinal direction of the cell to a common connecting busbar which is situated beyond the end wall of the cell and leads to the riser to the next cell.

The downstream cathode bar ends are connected in groups to a second kind of connecting busbar which runs along the long side of the cell to the previously mentioned common connecting busbar.

In U.S. Pat. No. 3,969,213 by displacing the symmetry with respect to the transverse axis of the cell it is possible to compensate for the vertical magnetic forces due to the return conductor bars.

SUMMARY OF THE INVENTION

It is an object of the present invention to employ a further improved busbar configuration to suppress the vertical components of the self-consistent magnetic field in the four corners of the cell, and this by means of an arrangement which, apart from the low cost of busbar material, also permits an optimum, low-ohmic overall resistance in the connecting busbars, thus lowering the running costs of the cell.

This object is achieved by way of the invention in that to compensate almost completely for the self consistent magnetic field of the cell, at the upstream cathode bar ends in each half of the cell, with respect to its transverse axis Q, at least two individual or groups of cathode busbars or connecting busbars run:

under the cell (10) completely, at its transverse axis, and between the transverse axis and the end of the cell to the longitudinal axis then, at approximately the same level, in the direction of the longitudinal axis unit just beyond the end wall of the cell before running parallel and close to this wall in the direction of the next cell and finally along the long side of the cell to a busbar which connects up with the downstream cathode bar ends or to a riser.

A connecting busbar situated in the region of the longitudinal axis of the cell is preferably arranged exactly symmetrical to the plane of that axis. If there is a plurality of connecting busbars there, then it also holds that these are preferably arranged not only symmetrical to the longitudinal axis but also as close as possible to it.

The busbars running under the cell close to the longitudinal axis and extending beyond the end wall of the cell are much longer than those running completely under the cell at its transverse axis. By appropriate choice of busbar cross section the ratio of overall electrical resistance from the cathode bar ends to the anode beam of the next cell can be set and chosen such that the desired subdivision of current takes place between the two types of connecting busbar. The same result could be achieved with the same cross section for both types of busbar but by employing for them metals of different electrical resistivity.

If in addition to compensating for the self consistent field of the cell compensation is to be made at the same time, the vertical magnetic forces due to the return part of the electrical circuit in the pot room, the cathode busbars and/or connecting busbars can be arranged in a conventional manner symmetrical to the transverse axis of the cell, for example as in the U.S. Pat. No. 4,224,127.

BRIEF DESCRIPTION OF THE DRAWING

The invention is explained in greater detail in the following with the help of an exemplified embodiment. The accompanying FIGURE shows schematically a section through a row of transverse electrolyte cells used to produce aluminum.

DETAILED DESCRIPTION

The direct electric current flows from one cell 10 in the general direction I to the next cell 12. Twelve upstream cathode bar ends 16 project out of one long side 14 of cell 10. These are, with respect to the transverse axis Q of the cell, connected symmetrically to two separate cathode busbars 18 running along the long side 14 of the cell.

The ends of the cathode busbars 18 close to the cell axis Q are connected via flexible strips to horizontal connecting busbars 20 which run completely under the cell. Approximately in the middle of the cathode busbars 18 further flexible strips lead off to connecting busbars 22 which initially run for a length 22A horizontally under the cell until reaching the region of the longitudinal axis L of the cell, where they run for a length 22B in the direction of the longitudinal axis L at approximately the same level until a few cm to 1 m beyond the cell end 24; a third part 22C runs along the end wall 24 of the cell 10, and a final length 22D along the side of cell 10 to join up with a common connecting busbar 28.

The twelve downstream cathode bar ends 30 are likewise connected to two cathode busbars 32 arranged symmetric to the transverse axis Q of the cell. A connecting piece 34 situated approximately at the middle of the cathode busbar joins up with a common connecting busbar 28 which leads to the anode beam 38 of the next cell via riser 36. The ends of the cathode busbars 32 facing the transverse axis Q are connected vis busbar 42 to a riser 40 likewise leading to anode beam 38.

Both the risers 36, 40 themselves and the busbars 44 leading to the anode beam 38 can be in the form of individually insulated, or pairs, or groups of busbars.

The asymmetry required to compensate the vertical magnetic field from the neighboring row of cells can be achieved to some extent in a conventional manner by differences in at least two of the pairs of busbars or in the length of the cathode bar ends e.g. by having an irregular number of cathode bar ends 16, 30 connected to the cathode busbars 18, 32, different total cross sections in the pairs of busbars, a different distance between the busbar piece 22C and the end wall 24 of the cell, and/or different lengths of cathode bar ends 16, 30 on opposite long sides of the cell, but symmetrically so, and a consequently given asymmetry in the connecting busbars 20, 22, 34.

What is claimed is:

1. Arrangement of busbars for conducting the direct electric current from the ends of the cathode bars of a transverse electrolytic cell to the facing long side of the anode beam of the next cell via cathode busbars, connecting busbars and risers, wherein at least a portion of the connecting busbars run under the cell, wherein in order to compensate almost completely for the self-consistent magnetic field of the cell, at the upstream cathode bar ends in each half of the cell, with respect to the transverse axis Q, at least two individual or groups of cathode busbars or connecting busbars run under the cell completely, at its transverse axis Q, and between the transverse axis Q and the end of the cell to the longitudinal axis (L) then, at approximately the same level, in the direction of the longitudinal axis until just beyond the end wall before running parallel and close to this wall in the direction of the next cell, and finally along the long side of the cell, to a busbar which connects up with the downstream cathode bar ends or to a riser.

2. Arrangement of busbars according to claim 1 wherein said cell is for producing aluminum.

3. Arrangement of busbars according to claim 1 wherein the connecting busbar or busbars leading the current in the longitudinal direction beyond the end wall are arranged symmetrical with respect to the longitudinal axis (L) of the cell.

4. Arrangement of busbars according to claim 1 wherein when there is a plurality of connecting busbars, the busbar sections which lead the current beyond the end wall are arranged symmetrical with respect to the longitudinal axis (L) and as close as possible to this axis.

5. Arrangement of busbars according to claim 1 wherein the cross section of the busbars leading the electric current beyond the end wall is larger than that of the busbars passing completely under the cell at the middle.

6. Arrangement of busbars according to claim 1 wherein the busbars conducting the electric current beyond the end wall are made of material which is a better electrical conductor than that used for the busbars which conduct the current completely under the cell at its middle.

7. Arrangement of busbars according to claim 1 wherein at least two of the pairs of cathode busbars or connecting busbars are arranged symmetrical with respect to the transverse axis (Q) of the cell.

8. Arrangement of busbars according to claim 1 wherein the length of the cathode bar ends is asymmetrical with respect to the transverse axis (Q) of the cell.

9. Arrangement of busbars according to claim 1 wherein the connecting busbar lies at a distance of a few cm to 1 m from the end wall of the cell.

* * * * *